United States Patent [19]

Merlo

[11] 4,238,816

[45] Dec. 9, 1980

[54] LAMP FOR THE MAINTENANCE, SERVICING AND REPAIRING OF MOTORVEHICLES

[76] Inventor: Mario Merlo, Via Montenero 19, 20029 Turbigo (Milano), Italy

[21] Appl. No.: 11,426

[22] Filed: Feb. 12, 1979

[30] Foreign Application Priority Data

Aug. 18, 1977 [IT] Italy ..... 22049/77[U]

[51] Int. Cl.[3] ..... F21V 21/26

[52] U.S. Cl. ..... 362/277; 362/306; 362/397; 362/419

[58] Field of Search ..... 362/397, 306, 277, 269, 362/419

[56] References Cited

U.S. PATENT DOCUMENTS 3,325,639 6/1967 King ..... 362/397 X

*Primary Examiner*—Stephen J. Lechert, Jr.

*Attorney, Agent, or Firm*—Stevens, Davis, Miller & Mosher

[57] ABSTRACT

A lamp which can be quickly fixed and fully revolving, particularly for use in maintenance and repair operations in motorvehicles, comprising a strong sucker base, a flexible stem, and a lampholder with directional reflector.

4 Claims, 2 Drawing Figures

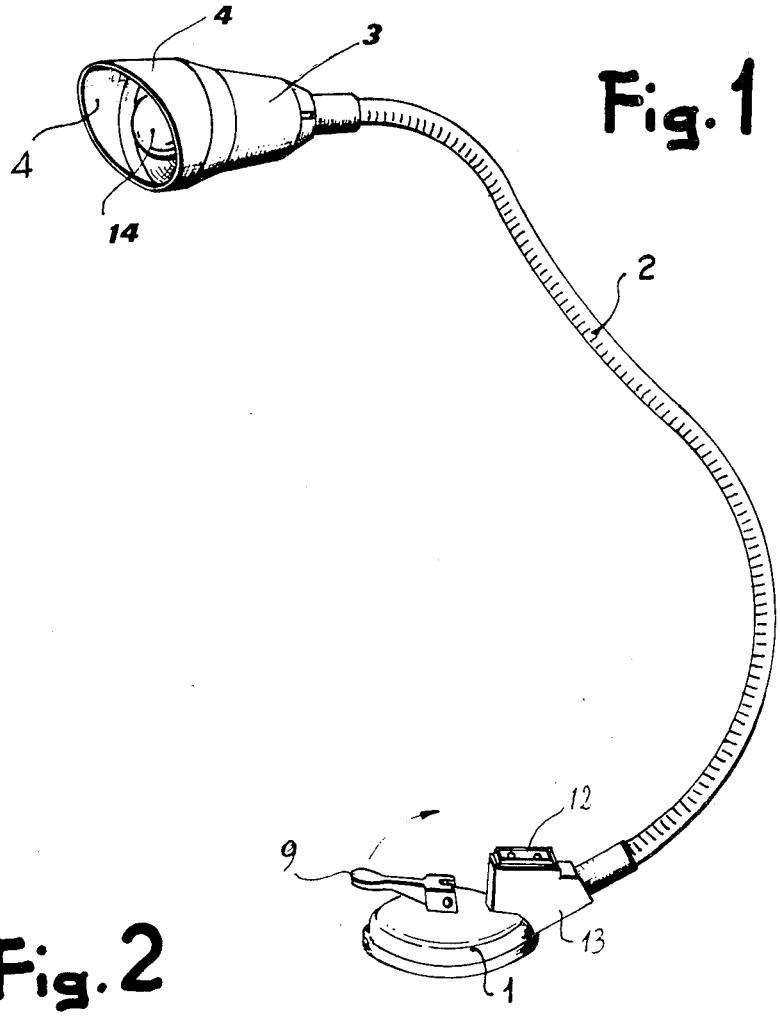
Fig. 1
Fig. 2
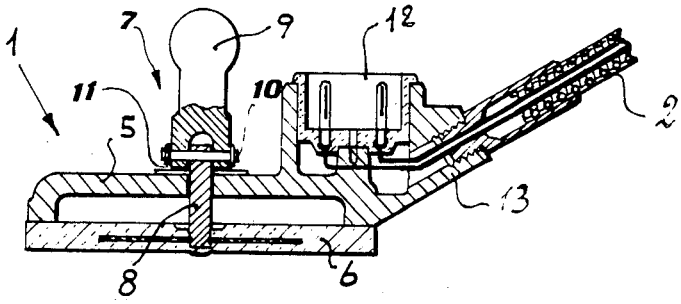

LAMP FOR THE MAINTENANCE, SERVICING AND REPAIRING OF MOTORVEHICLES

BACKGROUND OF THE INVENTION

It is known that one of the most important causes often making vehicle maintenance and repair operations difficult is the scarce lighting in the area where one is working. Since most of the components of a motorvehicle are inserted, sometimes even wound-up, in the structure of the body, natural light or the light supplied by usual lighting systems in the room where the work is done, are often inadequate. Of course it has been thought of overcoming the drawback by special lamps, but those realized up to date have not solved the problem in a rational and satisfying way. In practice, at present there exist:

the so called 'hand portable' lamp, which can be easily moved and therefore efficiently directed, but which prevents the worker from using his hands. Therefore it is necessary to have a person for the sole task of holding the 'portable' lamp and directing the light in a correct way, while another person effects the operation of maintenance or repair in the vehicle: hence, waste of time, double costs, little or no practicality;

the so-called 'bench' lamp which has supporting attachments to benches or rolling tables, detached and sometimes distant from the vehicle to be repaired, so that the lighting is poor, except in a few cases;

'flashlights', having the same handicaps as the hand portable lamp plus a scarce and limited-in-time lighting power, so that in practice they are generally only (and rightly) used when a vehicle has a breakdown.

The present invention provides an improved lamp, of original conception, specially devised to solve in the most practical, efficient and complete way the problem of lighting every part or zone of a motorvehicle on which maintenance or repair operations must be effected, in order to make such operations quicker and more comfortable, even when they are carried out by one operator only.

SUMMARY OF THE INVENTION

The lamp according to the invention is mainly characterized in that it comprises a strong sucker base, a flexible stem and a lampholder with directional reflector.

The base can suitably embody a socket of standard type for mains feeding or a housing for batteries or for accumulators for self-contained feeding.

In a particularly practical embodiment, the lamp according to the invention is further provided with a stem having a resiliant helical structure with a diameter decreasing from the base to the lampholder.

BRIEF DESCRIPTION OF THE DRAWING

By simple way of non limitative example, the invention will now be described with reference to the enclosed drawing which shows a preferred embodiment, in which:

FIG. 1 is a perspective view of the whole of the lamp according to the invention; and FIG. 2 is an enlarged cross section of the base of the lamp as per FIG. 1.

DESCRIPTION OF THE PREFERRED EMBODIMENT

With reference to the drawing, the lamp according to the invention comprises a strong base 1, a long flexible stem 2 and a lampholder 3 with directional reflector 4.

The base 1 is formed by a metal cap 5 and by a sucker comprising a rubber plate 6 closing the cap 5, and a central control 7 of said plate comprising a rod 8, emerging from the central part of the plate 6 toward the cap 5 and projecting from the top of said cap through a hole provided therein, a control lever 9 hinged in 10 at the end of said rod and positioned on the outside of the cap with the surface of which it contrasts, and a flat spring 11 positioned between said cap 5 and lever 9.

To the cap 5 there is combined a standard socket 12 next to the connection point 13 for the flexible stem 2. The lamp stem 2 is shown as having a resilient helical structure with a section decreasing from the base 1 to the lampholder 3.

The stem 2 can be made in a single piece having a section decreasing in a continuous way (as shown), or in various pieces each having a constant section smaller than the one of the preceding piece.

At the thinner end of the flexible stem 2 there is fixed a lampholder 3 for the bulb 14, to which there is associated the directional reflector 4 rotating on stem 2 around the axis of the lampholder 3, in order to better guarantee the desired direction of the light flash, in any working condition.

In practical use, the base 1 is applied to a flat or substantially flat surface of the vehicle, such as a door, a window-pane, a hood, or any other internal or external element of the body or of the frame, near the part where one has to work which is to be lighted. To this purpose, the plate 6 is rested on the surface and the lever 9 is manoeuvred by lifting the central part of the plate 6 in order to create under the cap 5 a vacuum which guarantees a very efficient and strong sucker attach of the base 1 onto the said surface. The lamp thus being fixed, one can work on the flexible stem 2 in order to position the lampholder 3 at best convenience. Finally, by working on the reflector 4, one can direct the light flash exactly on the desired spot and displace it with great easiness as required, thus obtaining a much more efficient lighting than by known means, in any point and for any type of work.

In the shown lamp, the current feeding takes place through a socket 12 by an ordinary cable connected to the network.

However, the lamp according to the invention could, at choice, be equipped with batteries or accumulators housed in a special housing provided in the cap 5 and combined to the cap itself, instead of the socket 12 or together with it. In this case the lamp would be independent from the network and could be used also in emergencies on board of motorvehicles, e.g. in case of necessary repairs on the road for breakdowns.

A lamp of this kind could also be provided with a blinking device, should it be desired to use it for signalling, in case of breakdowns on the road, besides its main task of lighting in maintenance and repair operations.

I claim:

1. A lamp which can be quickley fixed and fully revolving, particularly for use in maintenance and repair operations in motorvehicles, characterized in that it comprises a strong sucker base embodying a standard socket, a flexible stem consisting of a resilient element with helical structure having a decreasing section and a lampholder with directional reflector.

2. A lamp as claimed in claim 1 wherein said stem consists of a plurality of elements with a resilient helical structure each having a constant section smaller than the one of the preceding element.

3. A lamp as claimed in claim 1 wherein said directional reflector is rotatable on the flexible stem around the lampholder.

4. A lamp as claimed in claim 1 wherein said base sucker comprises a cap, a rubber plate closing the cap, a lever control outside the cap, and a rod connected to a central part of said plate and passing through said cap to engage said lever, said lever acting on said rod to move the central part of the rubber plate.

* * * * *